US010434681B2

(12) United States Patent
Luotoharju

(10) Patent No.: US 10,434,681 B2
(45) Date of Patent: Oct. 8, 2019

(54) METHOD AND APPARATUS FOR CASTING CONCRETE PRODUCTS

(71) Applicant: Elematic Oyj, Akaa (FI)

(72) Inventor: Janne Luotoharju, Tampere (FI)

(73) Assignee: Elematic Oyj, Akaa (FI)

( * ) Notice: Subject to any disclaimer, the term of this patent is extended or adjusted under 35 U.S.C. 154(b) by 533 days.

(21) Appl. No.: 15/007,279

(22) Filed: Jan. 27, 2016

(65) Prior Publication Data

US 2016/0214273 A1 Jul. 28, 2016

(30) Foreign Application Priority Data

Jan. 27, 2015 (FI) ..... 20155054

(51) Int. Cl.
*B28B 3/22* (2006.01)
*B28B 1/08* (2006.01)

(52) U.S. Cl.
CPC ..... *B28B 3/228* (2013.01); *B28B 1/084* (2013.01)

(58) Field of Classification Search
CPC ..... B28B 3/22; B28B 3/222; B28B 3/224; B28B 3/226; B28B 3/228; B28B 1/084
See application file for complete search history.

(56) References Cited

U.S. PATENT DOCUMENTS

| | | | |
|---|---|---|---|
| 4,046,848 A | 9/1977 | Putti | |
| 5,123,831 A | 6/1992 | Enqvist et al. | |
| 2014/0145361 A1 | 5/2014 | Raukola | |

FOREIGN PATENT DOCUMENTS

| | | | | |
|---|---|---|---|---|
| CN | 2212491 Y | 11/1995 | | |
| CN | 1121459 A | * 5/1996 | | ..... B28B 1/084 |
| CN | 1121459 A | 5/1996 | | |
| CN | 1938481 A | * 3/2007 | | ..... B28B 1/29 |
| CN | 1938481 A | 3/2007 | | |
| CN | 103847000 A | 6/2014 | | |
| EP | 0677362 | 10/1995 | | |
| EP | 0677362 A1 | 10/1995 | | |
| EP | 1270158 A1 | 1/2003 | | |
| EP | 1332851 B1 | 8/2006 | | |
| FI | 74649 | 11/1987 | | |
| GB | 879396 A | 10/1961 | | |
| SU | 636091 | 10/1978 | | |
| WO | 9936236 | 7/1999 | | |
| WO | 2005103414 A2 | 11/2005 | | |

OTHER PUBLICATIONS

Finnish Search report issued on Patent Application No. 20155054 dated Oct. 9, 2015.

* cited by examiner

*Primary Examiner* — Anthony Calandra
*Assistant Examiner* — Jamel M Nelson
(74) *Attorney, Agent, or Firm* — Berggren LLP

(57) ABSTRACT

A method and an apparatus for casting concrete products with a substantially horizontal slipform casting process, where concrete mass is fed under pressure through a restricted cross-section defining the product to be cast, wherein the upper surface of the restricted cross-section is formed of a plurality of sections, which sections are moved in back and forth trowelling motion in the casting direction, wherein the adjacent sections are moved at different phases and/or at different speeds.

10 Claims, 3 Drawing Sheets

METHOD AND APPARATUS FOR CASTING CONCRETE PRODUCTS

This application claims benefit of Finnish Patent Application No. 20155054, filed 27 Jan. 2015, the entire contents of which are incorporated herein by reference for all purposes.

BACKGROUND

1. Field

The present disclosure relates to casting of prefabricated concrete products with a substantially horizontal slipform casting, where concrete mass is fed through a restricted cross-section, which restricted cross-section proceeds along with the casting.

2. Description of Related Art

Prefabricated concrete elements and products, such as hollow-core slabs and solid concrete slabs, are conventionally cast as slipform casting on elongate casting beds in a continuous casting process. The length of said continuous casting process is defined either on the basis of the combined length of the elements to be cast, or on the basis of the maximum length of the casting bed. The length of casting beds used in slipform casting can be up to 150-200 m, depending on the size of the element factory. After the slipform casting equipment has cast a continuous slab on the casting bed, the cast concrete mix is allowed to cure on the casting bed. When the concrete mix is cured, the uniform cast concrete slab is sawed in predetermined lengths on the basis of the targets of usage of the final elements, and the sawn concrete elements are lifted off the casting bed to storage, to wait for transportation to their respective locations of usage.

In slipform casting devices, concrete mix is fed either in one or several stages to a casting mold moving along with the casting device, said mold being formed by side walls of the mold and vibrating beam defining the top surface of the mold, together with the casting bed. The side walls and vibrating beam of the casting mold perform a vibrating and/or trowelling compacting motion for compacting the concrete product. When casting hollow-core slabs, the slipform casting device is provided with means for forming the cavities. Generally a slipform casting device is a casting machine moving on a stationary casting bed along with the casting process, but a slipform casting device can also be realized as a stationary casting station, in which case the casting bed moves along with the casting process with respect to the casting station.

One of the most common types of slipform casting devices is an extruder. In an extruder-type slipform casting device, the concrete mix is fed on feed screws that extrude the concrete mix under pressure to the slipform casting mold. Thus, in an extruder-type casting device, the feeding of the concrete mix to a slipform casting mold is carried out in one single feed step. When casting hollow-core slabs, at the end of the feed screws is attached hollow-core forming members, such as hollow-core mandrels.

The form of the slipform cast product is defined by the restricted cross-section, i.e. the slipform casting mold, formed in an extruder by the top surface of the casting bed, and side plates and top trowelling plate. Thus the top trowelling plate of the slipform casting mold defines the shape of the upper surface of the product to be cast.

In the present day buildings and constructions the requirements for concrete elements vary greatly, which include their shapes also. Due to the compaction effect of the slipform mold in slipform casting, the change of the shape of the cross-section of the product to be cast from the normal rectangular is problematic.

SUMMARY

The present disclosure provides a solution for casting concrete products with wider variety of cross-sectional shapes with an extruder-type slipform casting process. This is achieved with a novel trowelling plate which is divided in plurality of level sections in relation to the casting direction, where the sections are moved in trowelling motion at different phases or at different speeds than the adjacent sections.

Preferably the adjacent sections are moved in back-and-forth trowelling motion in opposite phases at same speed so, that the adjacent sections move opposite direction through the whole movement distance. This achieves the greatest shearing compaction effect to the upper surface of the product to be cast.

With the sectional trowelling plate of an embodiment of the invention, the effect of the shearing compaction in the concrete product to be cast is enhanced, especially in the corners and angles of the product, which allows wider variety for the upper surface forms. This is not possible with prior art single part trowelling plates, since these cannot achieve sufficient compaction for corners and angles within the area of the trowelling plate.

In the method of an embodiment of the invention for casting prefabricated concrete products with a substantially horizontal slipform casting process, where concrete mass is fed under pressure through a restricted cross-section defining the product to be cast, the upper surface of the restricted cross-section is formed of a plurality of sections, and the sections are moved in back and forth trowelling motion in the casting direction, wherein the adjacent sections are moved at different phases and/or at different speeds. The different movement phases of speeds of the adjacent sections improve the compaction of the upper surface of the product to be cast and provide sufficient compaction for corners formed on the upper surface of the product to be cast.

The present disclosure also provides an apparatus for casting prefabricated concrete products with a substantially horizontal slipform casting, which apparatus comprises a restricted cross-section defining the product to be cast. The restricted cross-section is formed with side plates of the apparatus defining the side surfaces of the restricted cross-section, an upper surface of the casting bed defining the bottom surface of the restricted cross-section, and with a top trowelling or vibrating beam or plate defining the upper surface of the restricted cross-section. The apparatus also comprises elements for feeding concrete mass to the restricted cross-section, such as feed screws and/or concrete mass containers for example, in at least one feed stage. In the apparatus of an embodiment of the invention, the upper surface of the restricted cross-section comprises a plurality of sections, and the apparatus comprises devices for moving adjacent sections back and forth in trowelling motion at different phases and/or at different speeds.

In an embodiment of the invention at least some of the adjacent sections of the upper surface of the restricted cross-section are arranged at an angle relative to each other. This embodiment allows for casting of different upper surface shapes for the products to be cast.

In an embodiment of the invention between the adjacent sections of the upper surface of the restricted cross-section is arranged a gap of 0.5-2 mm. This distance is sufficient so that the movement of adjacent sections does not hinder each other but still small enough so that the concrete mass under pressure within the restricted cross-section does not excessively rise through the gap.

In an embodiment of the invention the upper surface of the restricted cross-section consist of sections in vertical orientation and horizontal orientation in relation to the lower surface of the restricted cross-section. This embodiment allows casting of concrete products with vertical extensions on the upper surface of the product to be cast, such as T and TT slabs.

In an alternative embodiment of the invention between the adjacent sections of the upper surface of the restricted cross-section is arranged a gap of 10-20 mm. This embodiment allows reinforcement bars and other similar parts extending from the upper surface of the concrete product to be cast pass through the trowelling plate, and through the whole casting machine, via the said gaps.

The features defining a method of the invention are more precisely presented as a method for casting concrete products with a substantially horizontal slipform casting process, where concrete mass is fed under pressure through a restricted cross-section defining the product to be cast, characterized in that the upper surface of the restricted cross-section is formed of a plurality of sections adjacent in the casting direction, which sections are moved in back and forth trowelling motion in the casting direction, wherein the adjacent sections are moved at different phases and/or at different speeds, and the features defining an apparatus of the invention are more precisely presented as an apparatus for casting concrete products with a substantially horizontal slipform casting, which apparatus comprises a restricted cross-section defining the product to be cast, and elements for feeding concrete mass under pressure to the restricted cross-section, characterized in that the upper surface of the restricted cross-section comprises a plurality of sections adjacent in the casting direction, and the apparatus comprises devices for moving adjacent sections back and forth in trowelling motion at different phases and/or at different speeds.

BRIEF DESCRIPTION OF DRAWINGS

In the following an embodiment of the invention is discussed in greater detail in the sense of example and with reference to accompanying drawings, where.

DETAILED DESCRIPTION OF SPECIFIC EMBODIMENTS

Figure 1:
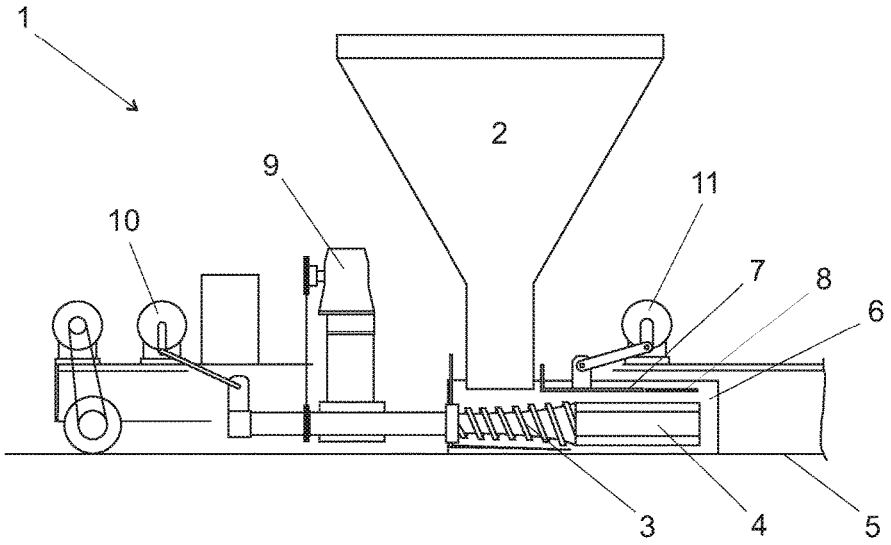
FIG. 1 shows schematically an extruder-type slipform casting apparatus.

FIG. 1 shows schematically an extruder-type slipform casting apparatus 1, which is operated during slipform casting process by feeding concrete mass from a concrete mass container 2 to feed screws 3, which feed screws extrude the concrete mass under pressure in a slipform casting mold formed by a casting bed 5, side plates 6, and a top trowelling plate 7. After the top trowelling plate 7 is located a levelling plate 8. At the downstream end of the feed screws 3 is connected core forming members or mandrels 4, which also restricts the slipfom casting mold and form cores as longitudinal voids in the slab to be cast. The concrete mass is compacted during the slipform casting process by the rotating motion of the feed screws 3 extruding the concrete mass achieved with a drive motor 9, and by back-and-forth movement in the casting direction of the feed screws and the core forming members 4 achieved with a drive motor 10. The outer surfaces of the product to be cast are compacted by back-and-forth movement of the side plates 6, and trowelling motion of the top trowelling plate achieved with a drive motor 11.

Figure 2A:
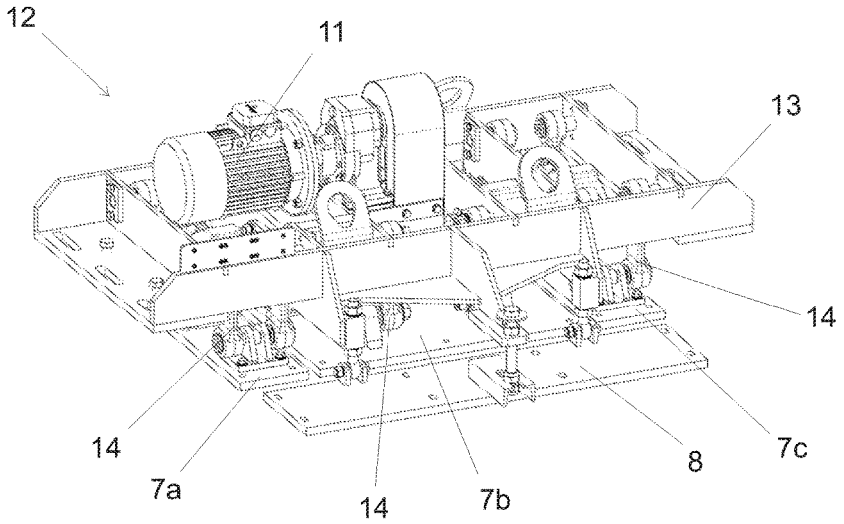
FIG. 2A shows an embodiment of a trowelling plate assembly of an embodiment of the invention.
Figure 2B:
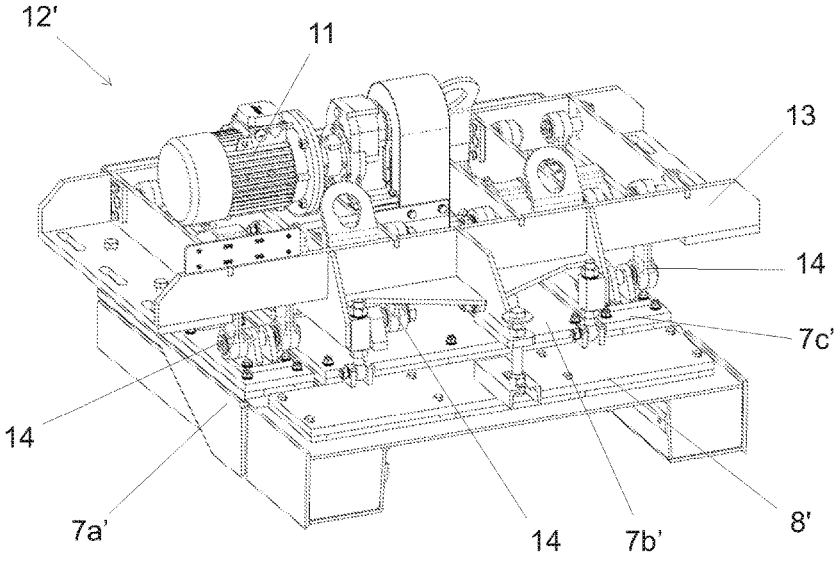
FIG. 2B shows an alternative embodiment of a trowelling plate assembly of the invention.

FIGS. 2A and 2B shows embodiments of trowelling beam assemblies 12, 12' of the invention, which form the top surface of the restricted cross-section of a slipform mold forming the product to be cast.

In the embodiment of FIG. 2A the trowelling beam assembly 12 comprises a frame part 13, through which the trowelling beam assembly is connected to the frame of the extruder-type slipform casting machine, a motor 11 for moving the three trowelling plate sections 7*a*, 7*b* and 7*c*. The motor 11 rotates a crankshaft (within the assemblies in FIGS. 2A and 2*b*) extending horizontally in transversal direction in relation to the movement directions of the trowelling plate over the trowelling plate sections 7*a*, 7*b* and 7*c*. The trowelling plate sections 7*a*, 7*b* and 7*c* are connected to the crankshaft via connecting rods, which cause the plate sections to move in back-and-forth movement when the drive shaft rotates. The connecting rods are connected to the crankshaft so, that the adjacent sections of the trowelling plate move in different phases in relation to each other, preferably in opposite phases so that the adjacent sections move opposite direction during the whole movement distance. The trowelling plate sections 7*a*, 7*b* and 7*c* are also connected to the frame part 13 via swivel arms 14.

After the trowelling plate sections 7*a*, 7*b* and 7*c* is located a levelling plate 8, which finishes and levels the upper surface of the concrete product to be cast.

In the embodiment of FIG. 2A the trowelling plate comprises three sections 7*a*, 7*b* and 7*c*, which are vertically aligned, so that the upper surface compacted with this embodiment will be level. The distance between the sections 7*a*, 7*b* and 7*c* is about 0.5-2 mm when uniform upper surface for the product to be cast is to be achieved. If reinforcement parts or other objects extending from the upper surface of the product to be cast are required, the distance between the sections 7*a*, 7*b* and 7*c* is about 10-20 mm, which allows these parts to pass through the trowelling plate between the sections.

The embodiment of FIG. 2B corresponds to the embodiment of FIG. 2A with the exception of the shape of the trowelling plate sections 7*a*', 7*b*' and 7*c*', and the shape of the levelling plate 8'.

In the embodiment of FIG. 2B the sections 7*a*' and 7*c*' at the sides of the trowelling plate are formed so, that they comprise both vertically and horizontally extending trowelling surfaces, and the middle section 7*b*' comprises only horizontally extending trowelling surface. The shape formed for the upper surface of the product to be cast can best be seen from the shape of the levelling plate 8', and an example of the shape of a concrete product cast with this trowelling plate is shown in FIG. 3B.

Figure 3A:
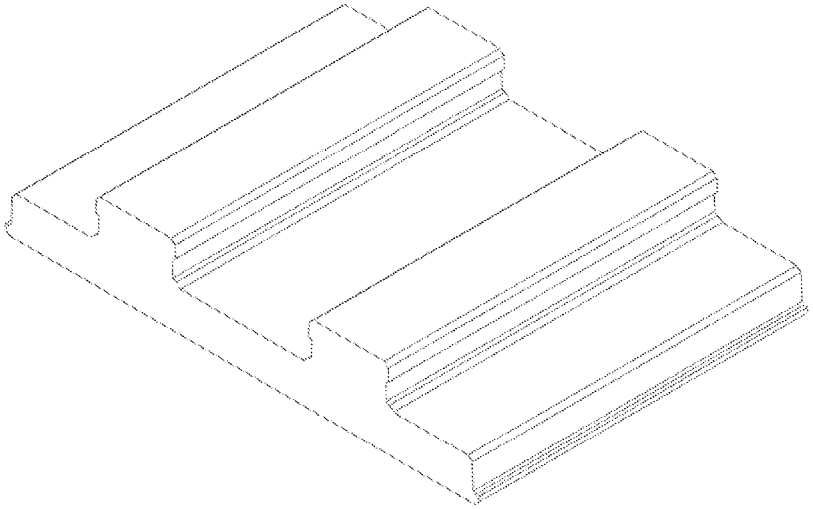
FIGS. 3A and 3B shows examples of concrete product shapes cast with a trowelling plate of an embodiment of the invention.
Figure 3B:
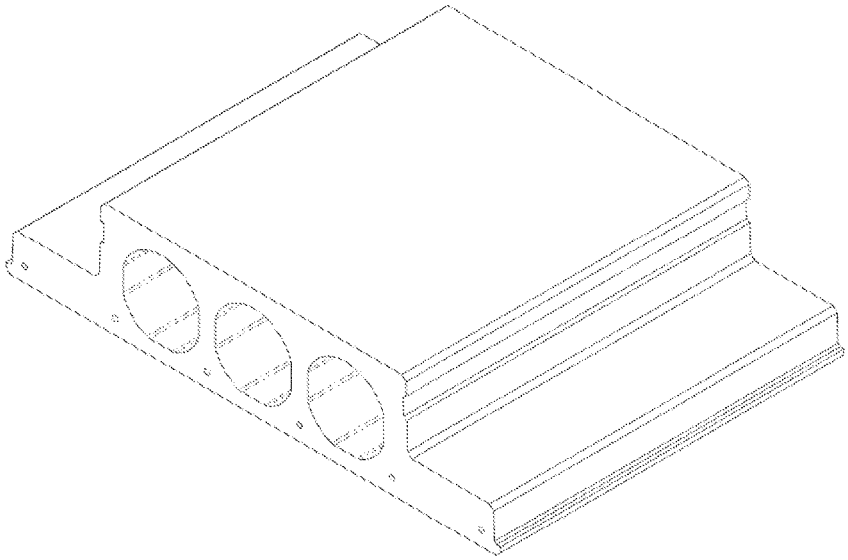

FIGS. 3A and 3B shows examples of concrete product shapes cast with a trowelling plate of an embodiment of the invention. As mentioned in previous paragraph, the trowelling plate assembly of FIG. 2B is used in casting the concrete product shape of FIG. 3B.

The casting of concrete product shape show in FIG. 3A requires trowelling plate formed of 5 to 9 sections. The side sections of the trowelling plate may be formed as substantially L-shaped trowelling both horizontal and vertical surfaces of the concrete product with a single section, and the middle portion may be formed with a substantially U-shaped trowelling plate section. Alternatively, each of the horizontal surfaces and vertical surfaces connecting the horizontal surfaces may be trowelled with a separate troweling plate sections.

The specific exemplifying embodiments of the invention shown in figures and discussed above should not be construed as limiting. A person skilled in the art can amend and modify the embodiments in many evident ways within the scope of the attached claims. Thus the invention is not limited merely to the embodiments described above.

The invention claimed is:

1. A method for casting concrete products with a substantially horizontal slipform casting process, where a concrete mass is fed under pressure through a restricted cross-section defining the product to be cast, wherein an upper surface of the restricted cross-section is formed of a plurality of sections adjacent to each other and having a gap of a predefined size between each of said adjacent section in the casting direction, comprising moving said adjacent sections in a back and forth troweling motion in the casting direction to enhance a compaction of the casted product, wherein the adjacent sections are moved at one or more of: different phases and different speeds.

2. The method according to claim 1, wherein at least some of the adjacent sections of the upper surface of the restricted cross-section are arranged at an angle relative to each other.

3. The method according to claim 1, wherein the predefined size of the gap is in a range of 0.5-2 mm arranged between the adjacent sections of the upper surface of the restricted cross-section.

4. The method according to claim 1, wherein the adjacent sections of the upper surface of the restricted cross-section are arranged in a vertical orientation and a horizontal orientation in relation to a lower surface of the restricted cross-section.

5. The method according to claim 1, wherein the predefined size of the gap is in a range of 10-20 mm arranged between the adjacent sections of the upper surface of the restricted cross-section.

6. An apparatus for casting concrete products with a substantially horizontal slipform casting, which apparatus comprises a restricted cross-section defining the product to be cast, and at least one feedscrew for feeding a concrete mass under pressure to the restricted cross-section, wherein a upper surface of the restricted cross-section comprises a plurality of sections adjacent to each other and having a gap of a predefined size between each of said adjacent section in the casting direction, and the apparatus comprises at least one motor for moving the adjacent sections back and forth in trowelling motion in the casting direction to enhance a compaction of the casted product at one or more of: different phases and different speeds.

7. The apparatus according to claim 6, wherein the adjacent sections of the upper surface of the restricted cross-section are arranged at an angle relative to each other.

8. The apparatus according to claim 6, wherein the predefined gap is a gap in a range of 0.5-2 mm arranged between the adjacent sections of the upper surface of the restricted cross-section.

9. The apparatus according to claim 6, wherein the adjacent sections of the upper surface of the restricted cross-section are arranged, in a vertical orientation and a horizontal orientation in relation to a lower surface of the restricted cross-section.

10. The apparatus according to claim 6, wherein the predefined gap is in a range of 10-20 mm arranged between the adjacent sections of the upper surface of the restricted cross-section.

* * * * *